US006705407B2

(12) United States Patent
Heinonen et al.

(10) Patent No.: US 6,705,407 B2
(45) Date of Patent: Mar. 16, 2004

(54) ROCK DRILLING AND MOUNTING FRAME

(76) Inventors: Jarmo Heinonen, Tesomankatu 20, D 22, FIN-33310 Tampere (FI); Jorma Mäki, Sorvajärventie 35, FIN-34140 Mutala (FI)

( * ) Notice: Subject to any disclaimer, the term of this patent is extended or adjusted under 35 U.S.C. 154(b) by 17 days.

(21) Appl. No.: 10/024,712

(22) Filed: Dec. 21, 2001

(65) Prior Publication Data

US 2002/0084110 A1 Jul. 4, 2002

Related U.S. Application Data

(63) Continuation of application No. PCT/FI00/00594, filed on Jun. 29, 2000.

(30) Foreign Application Priority Data

Jul. 2, 1999 (FI) ..... 991526

(51) Int. Cl.[7] ..... B25D 17/00

(52) U.S. Cl. ..... 173/105; 173/104; 173/216; 173/147; 173/152

(58) Field of Search ..... 173/48, 104, 105, 173/216, 217, 152, 147

(56) References Cited

U.S. PATENT DOCUMENTS 464,340 A * 12/1891 Grace ..... 173/48
1,918,065 A 7/1933 Terry
2,778,605 A * 1/1957 Hunn ..... 173/78
3,231,032 A * 1/1966 Geneberg et al. ..... 175/171
3,265,749 A * 8/1966 Curtis ..... 585/318
3,620,312 A * 11/1971 Krasnoff ..... 173/138
3,684,035 A * 8/1972 Wills ..... 173/147
3,800,886 A * 4/1974 Bazhal et al. ..... 173/93
3,858,666 A 1/1975 Bailey et al.
4,108,258 A * 8/1978 Ekwall ..... 175/320
4,842,079 A 6/1989 Heinonen
4,846,289 A 7/1989 Heinonen
5,771,982 A 6/1998 Briggs et al.

* cited by examiner

*Primary Examiner*—Scott A. Smith
*Assistant Examiner*—Chukwurah Nathaniel

(57) ABSTRACT

A rock drill includes a mounting frame to which a hammering apparatus and a rotating apparatus is arranged. The mounting frame is made maneuverable with respect to a feeding beam by means of slide blocks fastened to it, whereby a separate carriage is not needed between the drill and the feeding beam. Owing to the mounting frame, the hammering apparatus and/or the rotating apparatus can be replaceable modules. The invention further relates to a mounting frame which is arranged to transmit the feed and recoil forces directed to the drill to feeding means. The mounting frame comprises a section parallel to the feeding beam, to which slide blocks are fastened, and a transverse axial support thereto, to which the hammering apparatus and the rotating apparatus are mounted.

7 Claims, 5 Drawing Sheets

ROCK DRILLING AND MOUNTING FRAME

The present invention is a continuation of International Application No. PCT/FI00/00594, filed on Jun. 29, 2000, which was published in English as WO 01/02691 A1 on Jan. 11, 2001, and which claims priority to FI 991526, filed Jul. 2, 1999.

FIELD OF THE INVENTION

The invention relates to a rock drill intended to be arranged maneuverable in relation to a feeding beam, which rock drill comprises a rotating apparatus and a hammering apparatus and a mounting frame for mounting the rotating apparatus and hammering apparatus, and which mounting frame comprises an axial support, whereby the mounting frame is arranged to receive the feed and recoil forces directed to the rock drill and to transmit them to the feeding beam and feeding equipment, and which mounting frame can be supported to the feeding beam by means of slide blocks arranged to the mounting frame.

The invention also relates to a mounting frame which is a part of a rock drill and which comprises means for connecting a rotating apparatus and hammering apparatus belonging to the rock drill, and to which mounting frame slide blocks can be arranged to fit the mounting frame and the entire rock drill maneuverably to the feeding beam.

BACKGROUND OF THE INVENTION

In mining, rock drilling apparatuses are used, in which one or more booms are arranged on a movable platform and at the free ends of the booms, there is a feeding beam and a rock drill. In prior art solutions, one of which is presented later in FIG. 1, a rock drill is formed by connecting a rotating apparatus 2 and a hammering apparatus 3 into one entity by means of binding bolts 1 or by other means. This kind of a rock drill is usually connected with a bolted joint through lugs 4 in the jacket of the rock drill to a carriage 5 which can be moved along the longitudinal axis of the feeding beam 6 by means of feeding means, such as power transmission wires and hydraulic cylinders running them. The feeding movement of a rock drill is achieved by moving the carriage and the rock drill connected to it along the top surface of the feeding beam and supported by slide blocks 7 arranged to the carriage. Rock drilling produces extensive forces when the rock drill is, during drilling, fed against the rock and further when the impacts of the hammering apparatus reflect from the drilling object along the drill rod arrangement back to the rock drill. These forces create problems in the durability of the rock drill structures. Since present rock drills are made up of blocks mounted to each other with joint surfaces between them, small movement always occurs in the surfaces in spite of the mounting, causing wear and deformation in the surfaces. As a result of this, the use of the rock drill may need to be interrupted for maintenance even though the rotating apparatus or the hammering apparatus needs no repair. This causes thus extra production shutdowns and additional costs. Further, since the forces directed to the rock drill are transmitted through the jacket of the drill to the carriage, the jacket needs to be made massive.

U.S. Pat. No. 4,842,079 discloses a rock drill whose body has cylindrical chambers. In this case, the hammering apparatus and rotating apparatus are cartridges which are locked inside the chamber by means of end covers. The cartridges must have a certain shape and dimensioning to fit into their chambers, to lock in place by means of the end covers and to function. In addition, the cartridges require chamber support to function. Typically, the cartridges also need exact positioning in the chamber so that the required pressure medium channels between the chamber and the cartridge connect to make the apparatus function.

SUMMARY OF THE INVENTION

The object of this invention is to provide a novel type of rock drill and a mounting frame for mounting the rock drill so as to avoid the problems occurring with the known solutions.

The rock drill of the invention is characterized in that at least the rotating apparatus or the hammering apparatus of the rock drill is a replaceable module and that the axial support has at least one joint surface to which the replaceable module can be mounted and correspondingly dismounted without dismantling the remaining structure of the drill.

Further, the mounting frame of the invention is characterized in that it comprises at least one joint surface to which the replaceable rotating apparatus and/or hammering apparatus module can be mounted.

The basic idea of the invention is that the rock drill comprises a rotating apparatus and a hammering apparatus, of which at least one is a replaceable module. A further idea is that the rock drill comprises a mounting frame to which the rotating apparatus and hammering apparatus are mounted so that the rotating apparatus, hammering apparatus and mounting frame together form the drill. The mounting frame comprises beams parallel to a feeding beam, to which slide blocks are fastened, and an axial support transverse to the beams, by means of which the rotating apparatus and hammering apparatus are mounted to the mounting frame. Forces for moving the drill are brought to the mounting frame and correspondingly, the mounting frame receives the forces directed from the drill rod to the drill and transmits them to the feeding equipment. Further, the basic idea of a preferred embodiment of the invention is that joint surfaces are formed on both sides of the platelike axial support for the rotating apparatus and correspondingly, for the hammering apparatus. Thus, both the rotating apparatus and the hammering apparatus can be easily replaceable modules. The basic idea of another preferred embodiment of the invention is that the body of the rotating apparatus is a part of the mounting frame. Then the axial support is made up of the jacket of the rotating apparatus and the joint surface at its back end, to which joint surface the hammering apparatus can be mounted.

The invention provides the advantage that by means of the mounting frame it is possible to control better than before the feed and recoil forces directed to the rock drill, since they are transmitted in an advantageous manner by means of the mounting frame directly to the feeding beam and to transmission means of the drill arranged to it. This helps avoid the damage and wear caused by the forces to the drill structures and the joint surfaces of the various blocks of the drill. In addition, the invention provides the advantage that it is no longer necessary to have a separate carriage between the feeding beam and the drill, but the rock drill can be arranged directly to the feeding beam owing to the mounting frame. Since the carriage is unnecessary, it also needs not to be manufactured. The structure becomes simpler and more endurable. A further advantage of the invention is that the mounting frame makes it possible to form a modular drill. This way, it is possible to conveniently change the hammering apparatus and/or the rotating apparatus to the drill by means of the mounting frame joint surface. Various rotating apparatuses and hammering apparatuses having different output and properties can then be combined with each other to form the best possible combination for each purpose. It is now possible to manufacture certain basic modules which can then be suitably combined into various applications. This way, manufacturing costs remain clearly lower than if a separate construction was always built for each application. Since it is also possible to quickly detach a defective module or one needing maintenance even at the drill site without dismantling the entire structure and to replace it with an operational module, servicing the drill becomes significantly easier. In prior art solutions, either the entire drill had to be replaced or it had to be dismantled for maintenance, whereas now, owing to the structure of the invention, the entire drill need not be detached or dismantled, but only the defective module is detached for maintenance. The service lives of the rotating apparatus and the hammering apparatus usually differ from each other due to a different structure and operating principle. Their service life is also affected by the use they are in. Thus, the rotating apparatus and the hammering apparatus do not necessarily become defective or otherwise require maintenance at the same time, and owing to the invention, it is possible to only take care of the module requiring repair. A defective, replaced module can then be serviced in better conditions and used again later on. This also helps avoid long maintenance shutdowns and the related costs, as the defective rock drill can now be quickly put back into production use. In summary, by means of the invention, it is possible to avoid problems caused by the feed and recoil forces directed to the drill, to provide a simpler structure without the carriage, to customize, owing to the modular structure, an effective rock drill for each purpose, and to create significant savings due to easier maintenance and repair work and shorter shutdowns.

BRIEF DESCRIPTION OF THE FIGURES

The invention is described in greater detail in the attached drawings in which.

DETAILED DESCRIPTION OF THE INVENTION

Figure 1:
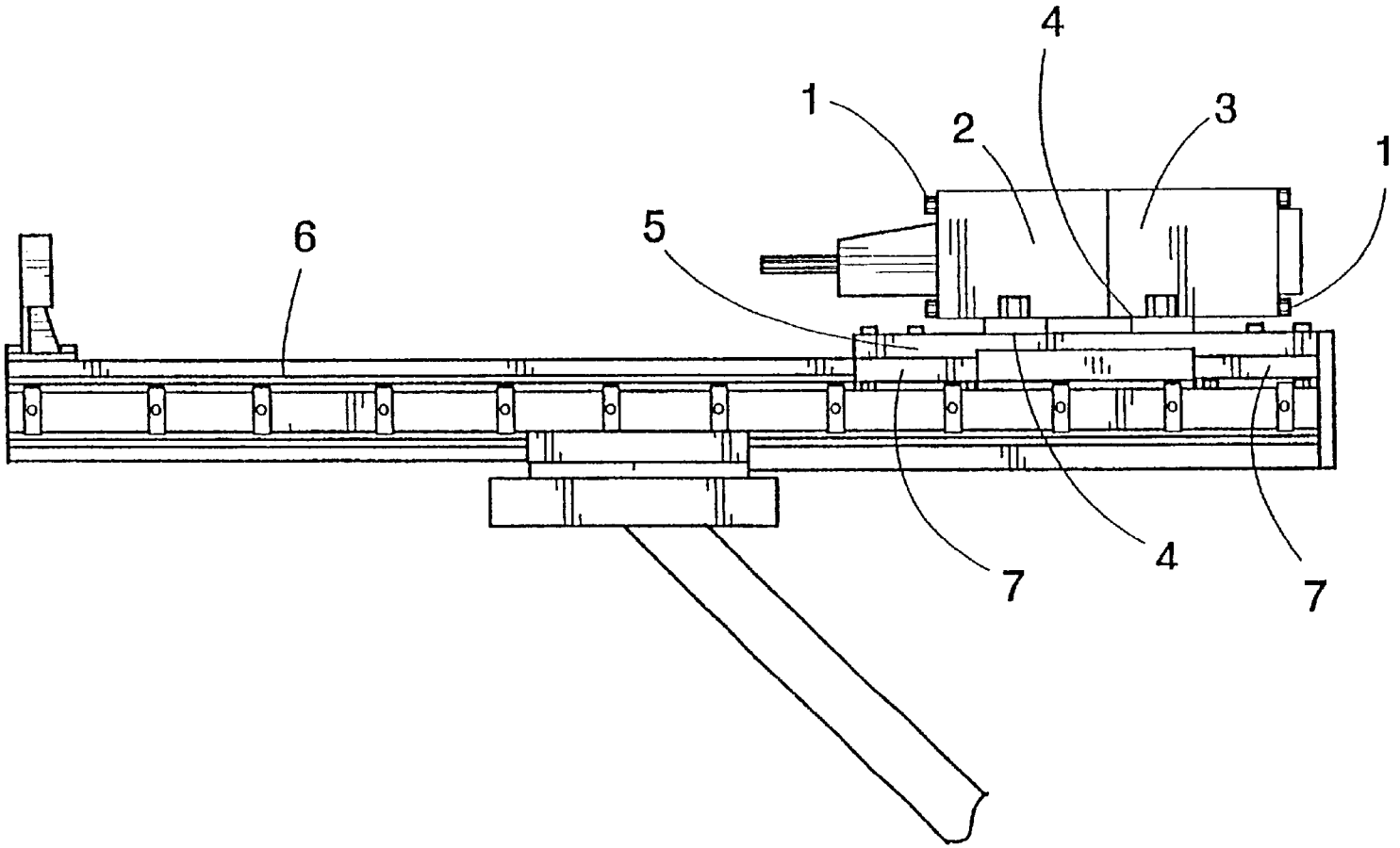
FIG. 1 PRIOR ART
FIG. 1 shows a prior art solution.

FIG. 1 shows a prior art solution, with respect to which reference is made to the paragraph describing prior art on page 1.

Figure 2:
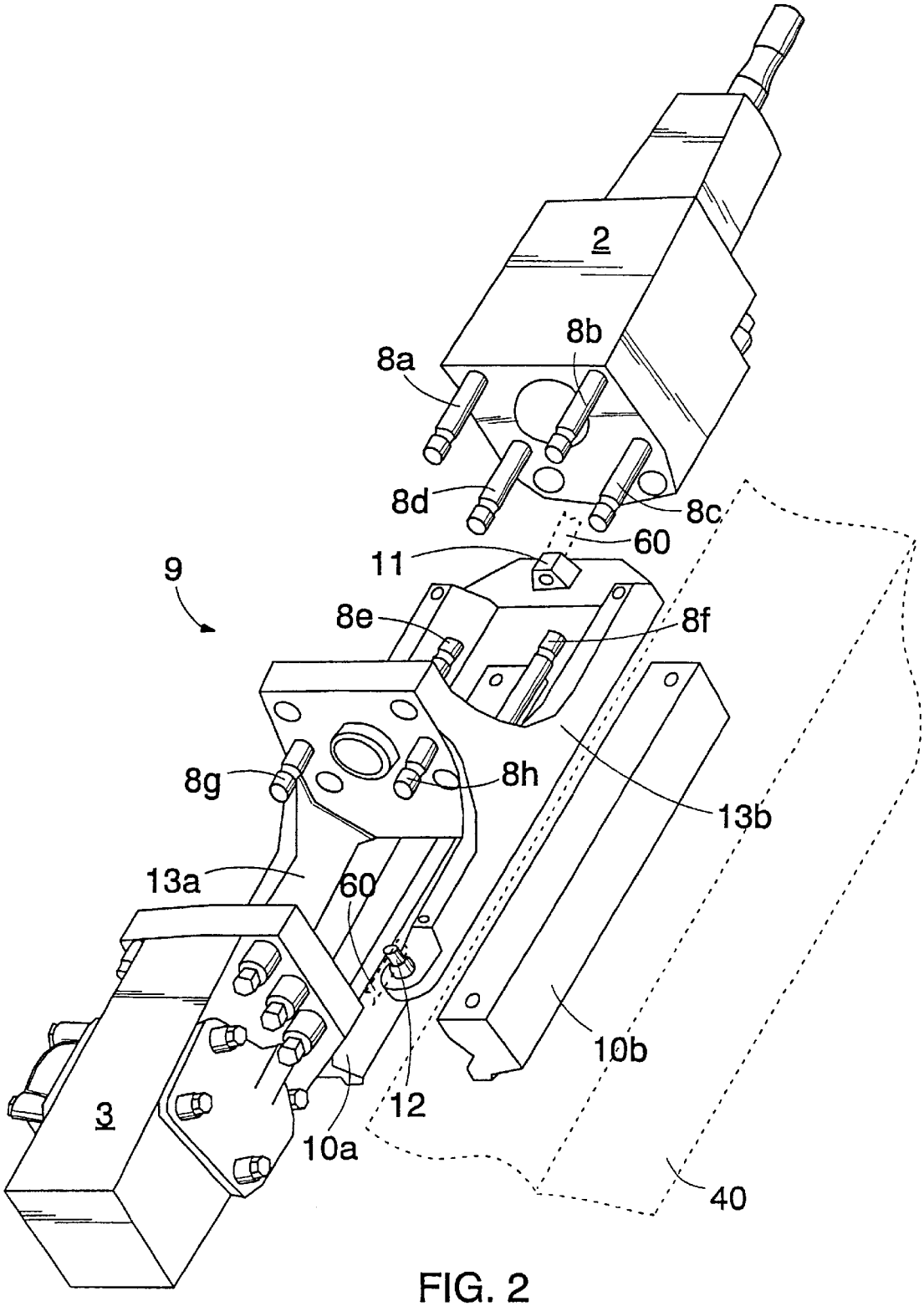
FIG. 2 is a schematic perspective view of a rock drill of the invention.

FIG. 2 shows a rock drill of the invention in a simplified manner for clarity's sake. At its forward end, the rock drill has a rotating apparatus 2 for rotating the drill rods and the drill bit coupled to them. The drill also comprises a hammering apparatus 3 for providing impacts to enhance the drilling. The operation and structure of the rotating apparatus and the hammering apparatus in general are known to a person skilled in the art and thus need not be described in more detail herein. In the solution of the figure, the rotating apparatus and the hammering apparatus are separate modules which are mounted by means of fastening bolts 8*a* to 8*h* or the like to an axial support 14 of a mounting frame 9, against joint surfaces 18 in the axial support. The module mounted to the joint surface of the axial support has a body of its own. It is then enough that the module is only supported to the joint surface of the axial support. In comparison with various cartridge type replaceable parts, this kind of module is easy and quick to replace in one piece. In addition, because the module has its own body and outer jacket, handling it during module replacement and maintenance, for instance, is easy. The mounting frame 9 is an important part of the drill structure, because without the mounting frame, it is not possible to use modules in drilling. The drill is arranged by means of the mounting frame directly to a feeding beam 40 of the rock drill in such a manner that it is maneuverable with respect to it and without any separate carriage. Slide blocks 10*a* and 10*b* or the like are fastened to the lower surface of the mounting frame to act as bearing elements between the mounting frame and the feeding beam. A slide block typically comprises a body and a replaceable wearing piece 50. Slide blocks are preferably fastened with a bolted joint or the like so that they can be conveniently replaced when the wearing pieces are worn. The figure also shows a lug 11 at the forward end of the mounting frame, to which a feed wire 60 or the like is fastened for transmitting the force providing the feeding movement from a hydraulic cylinder or corresponding actuator to the mounting frame. Correspondingly, at the back end of the mounting frame, on its both sides, there are pins 12 or the like to which elements with which the drill is pulled backward can be connected. For clarity's sake, the rotating apparatus, the hammering apparatus and the slide blocks are shown separated from the mounting frame.

Figure 3:
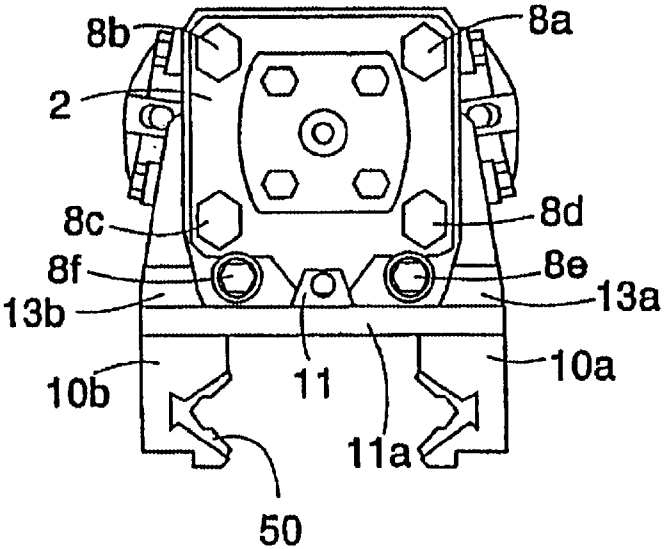
FIG. 3 is a schematic front view of the rock drill of FIG. 2.
Figure 4:
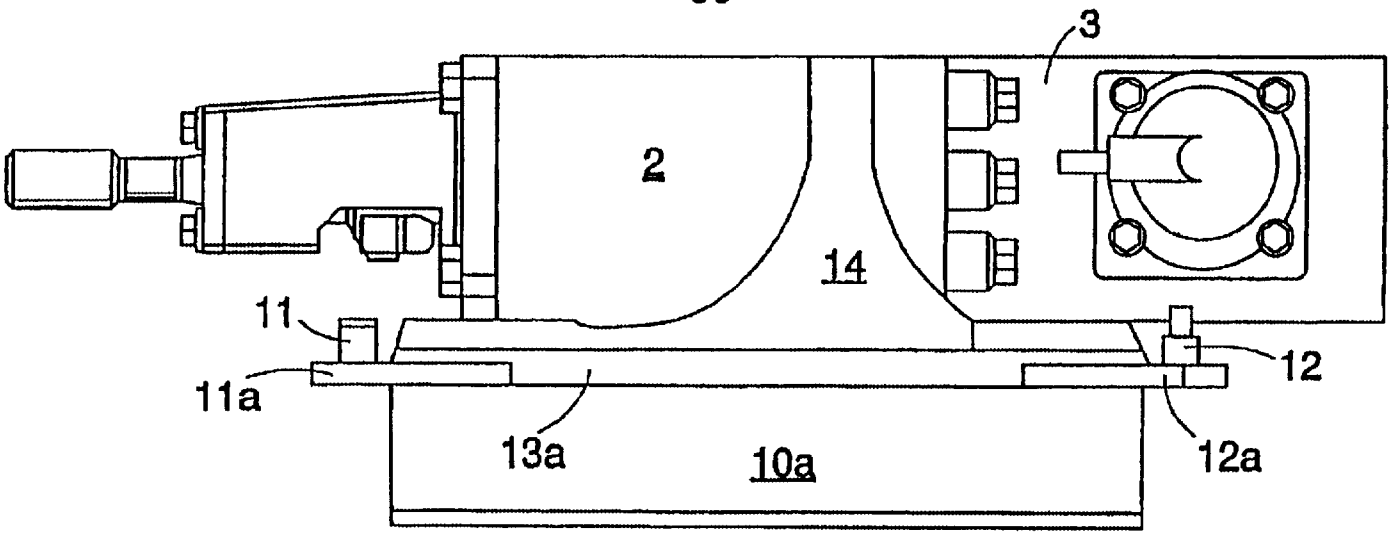
FIG. 4 shows the same structure from the side.

FIG. 3 shows a drill according to FIG. 2 from the front, i.e. as seen from the drill rod side. Correspondingly, FIG. 4 shows a side view of the drill. As seen from the figures, the lug 11 and pins 12 required to move the drill are arranged to the mounting frame by means of transverse supports 11*a* and 12*a* arranged between the beams. These supports can, at the same time, also support the beams to each other.

Figure 5A:
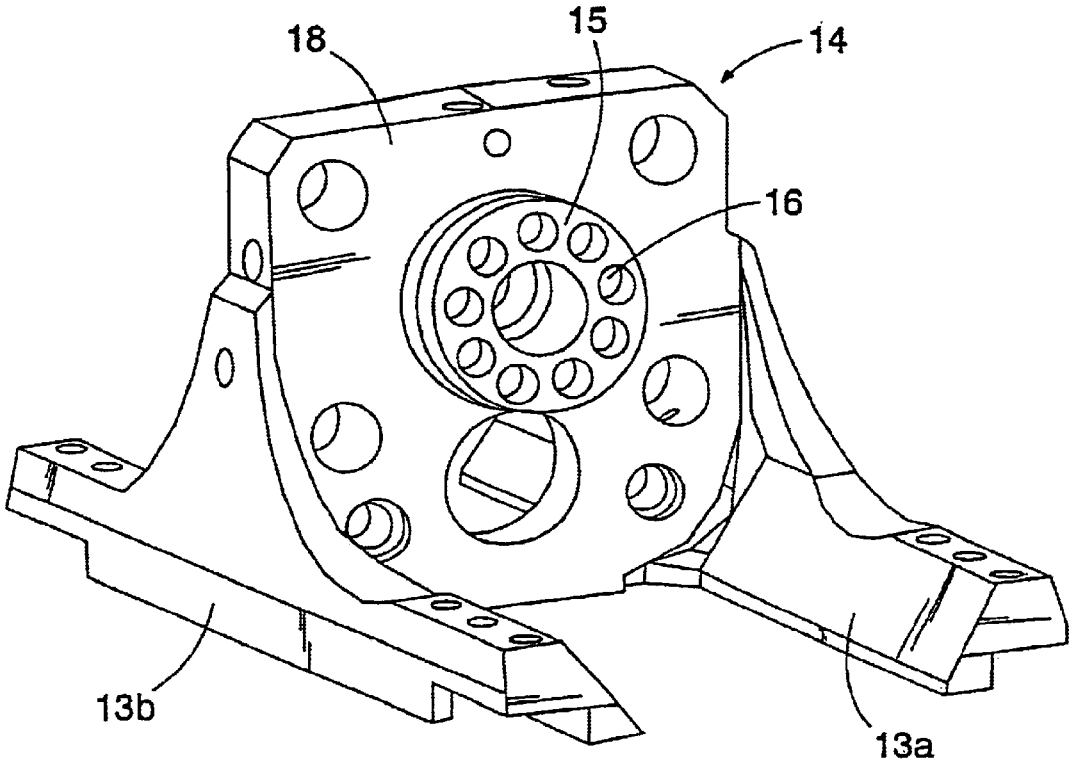
FIG. 5*a* shows a schematic view of the structure of a possible mounting frame seen from the side of the rotating apparatus.
Figure 5B:
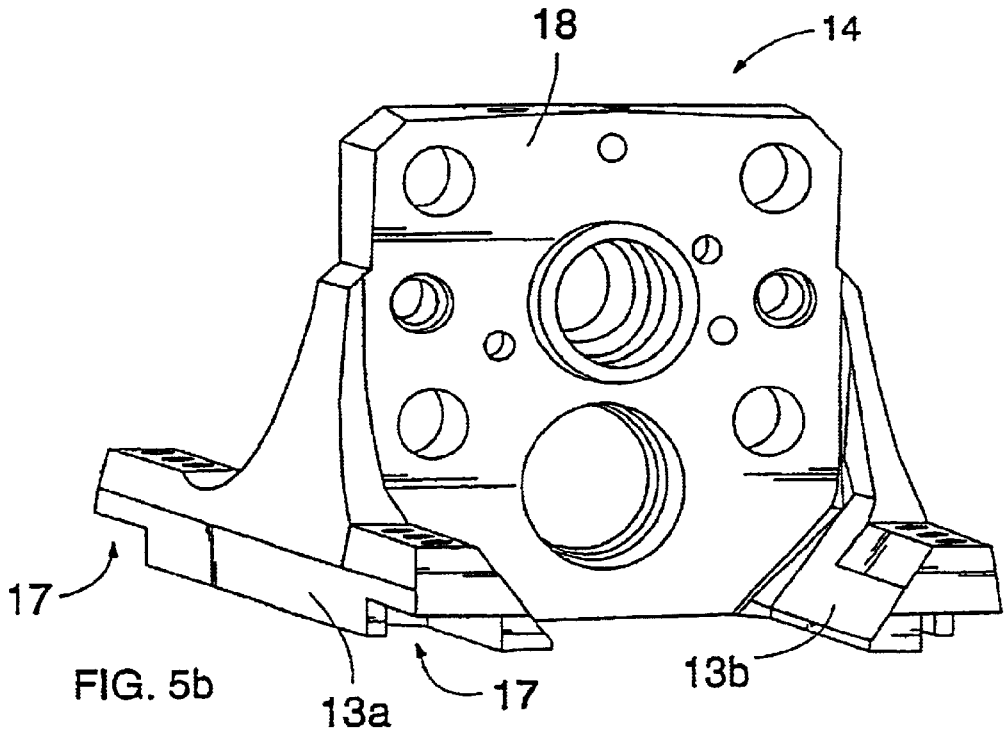
FIG. 5*b* shows the same mounting frame seen from the side of the hammering apparatus.

FIG. 5*a* shows the mounting frame from the front and FIG. 5*b* from the back. As earlier stated, the mounting frame 9 forms the frame of the drill to which the rotating apparatus and the hammering apparatus are mounted. The mounting frame acts as a force-transmitting element and a mounting platform for the modules. The mounting frame is preferably made up of beams 13*a* and 13*b* parallel to the feeding beam. The mounting frame also comprises an axial support 14 arranged to the beams, which in the application of the figure is a plate-like piece set transversely between the beams. The axial support 14 is substantially perpendicular to the beams 13*a* and 13*b* and it is preferably supported to the beams by means of curved or triangular sections, whereby the axial support endures well the feed and recoil forces transmitted thereto. The axial support also connects the beams to each other. The beams 13*a* and 13*b* preferably comprise supports directed upward at the axial support, to which the axial support made of plate material is then joined by welding it fixed or making it detachable with a combination of form clamping and a bolted joint. The mounting frame can naturally also be made by casting, in which case it is a uniform piece. The axial support has holes for the fastening bolts 8*a* to 8*f*. Further, it naturally has a hole through which the impact made by the hammering apparatus is transmitted to the drill shank with the percussion piston directly or with a pin extending from it. The hole may have a cone adapter which facilitates the mounting of the modules.

The rotating apparatus is fastened to the mounting frame by means of bolts 8*a* to 8*d* extending through the axial support and bolts 8*e* and 8*f* screwed on the axial support. The hammering apparatus is also fastened by means of bolts 8*a* to 8*d* and bolts 8*g* and 8*h* screwed on the axial support. Bolts 8*a* to 8*d* thus join the rotating apparatus, the hammering apparatus and the mounting frame together. Detaching the rotating apparatus or the hammering apparatus thus requires that the fastening bolts 8*a* to 8*d* be opened. After the bolts 8*a* to 8*d* are opened, the modules still remain in place, however, until the module-specific bolts 8*e* and 8*f* and, correspondingly, 8*g* and 8*h* have been opened. The modules can thus be detached from the mounting frame separately. Naturally, the modules can be fastened in another manner and other kinds of suitable fastening means can be used.

FIG. 5*a* in particular shows an axial bearing 15 arranged preferably to the mounting frame, which bearing dampens the impacts, i.e. recoil, of the hammering apparatus reflecting back from the drilled object. The axial bearing comprises pistons arranged in cylinder chambers 16 formed in a circle, the pistons being connected so that, due to recoil forces, they can move backward in the cylinder chambers at the same time pushing hydraulic fluid to a hydraulic fluid space connected to the back of the cylinder chambers, the hydraulic fluid space being also connected to a pressure accumulator or the like. The axial bearing can be arranged fixedly to the axial support, but it is preferably a separate, easily detachable and replaceable component which is arranged to the axial support in a housing made for it and locked in place with a locking screw, for instance. FIGS. 5*a* and 5*b* also show that recesses 17 can be made on the bottom surfaces of the mounting frame beams for sturdy fastening of the slide blocks.

Figure 6:
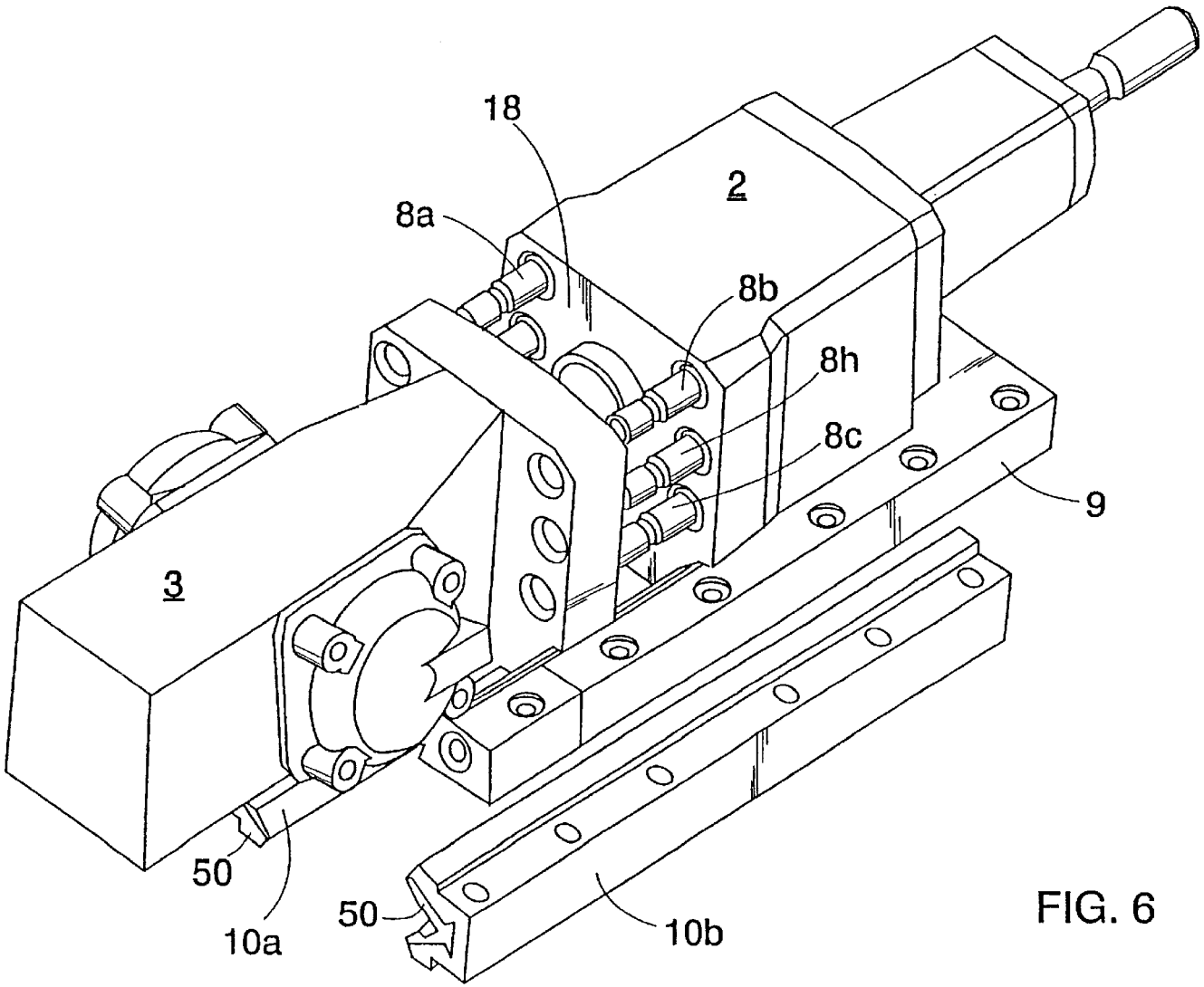
FIG. 6 is a schematic perspective view of a second mounting frame of the invention and the rock drill formed around it.

FIG. 6 shows a second preferred application of the rock drill and mounting frame of the invention. In this solution, the mounting frame comprises an U-shaped beam with the body of the rotating apparatus arranged to its closed end. Further, at the hammering apparatus side of the jacket of the rotating apparatus, a joint surface 18 is formed for mounting the hammering apparatus. In this solution, the jacket of the rotating apparatus and the joint surface form the axial support of the mounting frame. As in the solutions described in FIGS. 2 to 5, in this solution, too, the slide blocks are fastened to the bottom surface of the mounting frame. Means for connecting the feeding means can also be arranged to this mounting frame. The equipment inside the jacket of the rotating apparatus can be changed by opening the front of the rotating apparatus. The hammering apparatus is, however, a module that can be conveniently replaced in its entirety. The presented structure is suited for solutions in which it is necessary to be able to use different hammering apparatuses in the rock drill.

The drawings and the related description is only intended to illustrate the idea of the invention. The invention may vary in detail within the scope of the claims. The outer dimensions of the modules to be mounted to the joint surface of the axial support may vary. It is enough that the joint surfaces of the module and the axial support match and that the outer dimensions of the module to be mounted do not impede the use of the rock drill. The solution thus makes it possible to use modules differing in output, properties and dimensions when a drill is customized for various purposes. Even though the figures and their description only present beam-structured mounting frames, the construction may well be of another kind. The mounting frame may, for instance, be made up of a plate base to which, depending on the structure, a transverse plate-like axial support or an axial support formed by the rotating apparatus body and its joint surface is fastened. It is also possible that both the hammering apparatus and the rotating apparatus are arranged on one side of the axial support.

What is claimed is:

1. A rock drill adapted to be maneuverably arranged relative to a feeding beam, comprising:

a rotating apparatus and a hammering apparatus, at least one of the rotating apparatus and the hammering apparatus being a replaceable module, and a mounting frame for mounting the rotating apparatus and hammering apparatus, the mounting frame including an axial support, the mounting frame being arranged to receive feed and recoil forces directed to the drill and to transmit them to a feeding beam and feeding equipment, the mounting frame being supported relative to the feeding beam by slide blocks arranged on the mounting frame, wherein the axial support has at least one joint surface to which the replaceable module is mountable and correspondingly dismountable without otherwise dismantling the structure of the drill.

2. A rock drill adapted to be maneuverably arranged relative to a feeding beam, comprising:

a rotating apparatus and a hammering apparatus, at least one of the rotating apparatus and the hammering apparatus being a replaceable module, and a mounting frame for mounting the rotating apparatus and hammering apparatus, the mounting frame including an axial support, the mounting frame being arranged to receive feed and recoil forces directed to the drill and to transmit them to a feeding beam and feeding equipment, the mounting frame being supported relative to the feeding beam by slide blocks arranged on the mounting frame, wherein the axial support has at least one joint surface to which the replaceable module is mountable and correspondingly dismountable without otherwise dismantling the structure of the drill, and wherein the mounting frame includes two longitudinal beams parallel to the feeding beam, the axial support is arranged between the two longitudinal beams, and the axial support is a plate-like piece provided with joint surfaces on two sides thereof for mounting a rotating apparatus module and a hammering apparatus module.

3. A rock drill adapted to be maneuverably arranged relative to a feeding beam, comprising:

a rotating apparatus and a hammering apparatus, at least one of the rotating apparatus and the hammering apparatus being a replaceable module, and a mounting frame for mounting the rotating apparatus and hammering apparatus, the mounting frame including an axial support, the mounting frame being arranged to receive feed and recoil forces directed to the drill and to transmit them to a feeding beam and feeding equipment, the mounting frame being supported relative to the feeding beam by slide blocks arranged on the mounting frame, wherein the axial support has at least one joint surface to which the replaceable module is mountable and correspondingly dismountable without otherwise dismantling the structure of the drill, and wherein a body of the rotating apparatus is a part of the mounting frame, and a side of the body of the rotating apparatus closest to the the hammering apparatus includes a joint surface for mounting the hammering apparatus module, and the axial support is formed by the body of the rotating apparatus and the joint surface.

4. A rock drill adapted to be maneuverably arranged relative to a feeding beam, comprising:

a rotating apparatus and a hammering apparatus, at least one of the rotating apparatus and the hammering apparatus being a replaceable module, and a mounting frame for mounting the rotating apparatus and hammering apparatus, the mounting frame including an axial support, the mounting frame being arranged to receive feed and recoil forces directed to the drill and to transmit them to a feeding beam and feeding equipment, the mounting frame being supported relative to the feeding beam by slide blocks arranged on the mounting frame, wherein the axial support has at least one joint surface to which the replaceable module is mountable and correspondingly dismountable without otherwise dismantling the structure of the drill, and wherein the axial support comprises an axial bearing arranged to receive and dampen axial forces directed to the drill.

5. A mounting frame of a rock drill, the mounting frame comprising:

a frame which is part of the rock drill;

at least one joint surface associated with the frame and to which at least one of a replaceable rotating apparatus module and a replaceable hammering apparatus module is mountable; and slide blocks adapted to attach the frame maneuverably to a feeding beam, and wherein the mounting frame includes two substantially parallel longitudinal beams disposed at a distance from each other and a plate-like axial support including joint surfaces on two sides thereof for mounting the replaceable rotating apparatus module and the replaceable hammering apparatus module, and wherein the axial support is arranged approximately in a middle area between the longitudinal beams, and wherein the joint surfaces are substantially perpendicular to the longitudinal beams.

6. A mounting frame as claimed in claim 5, wherein the mounting frame comprises a fastening point to which feeding means are adapted to be fastened.

7. A mounting frame as claimed in claim 5, wherein a jacket of a rotating apparatus module forms a part of the mounting frame.

* * * * *

UNITED STATES PATENT AND TRADEMARK OFFICE

CERTIFICATE OF CORRECTION

PATENT NO. : 6,705,407 B2
APPLICATION NO. : 10/024712
DATED : March 16, 2004
INVENTOR(S) : Jarmo Heinonen et al.

It is certified that error appears in the above-identified patent and that said Letters Patent is hereby corrected as shown below:

Title Page,
Item [73], Assignee, please insert --Sandvik Tamrock, Oy, Tampere, Finland--.

Signed and Sealed this

Seventeenth Day of October, 2006

JON W. DUDAS
*Director of the United States Patent and Trademark Office*